United States Patent [19]

Yokote

[11] Patent Number: 5,020,039

[45] Date of Patent: May 28, 1991

[54] WATCH CASING WITH WRIST BAND SWITCH

[75] Inventor: Takasuke Yokote, Tokyo, Japan

[73] Assignee: Seiko Instruments Inc., Japan

[21] Appl. No.: 491,440

[22] Filed: Mar. 9, 1990

[30] Foreign Application Priority Data

Mar. 10, 1989 [JP] Japan ..... 1-27731[U]

[51] Int. Cl.[5] ..... G04B 37/12; G04B 1/00

[52] U.S. Cl. ..... 368/282; 368/204; 224/165

[58] Field of Search ..... 368/281-282, 368/319-321, 203-204, 276, 10, 80, 82

[56] References Cited

U.S. PATENT DOCUMENTS

| | | | |
|---|---|---|---|
| 3,971,207 | 7/1976 | Murakami et al. | 368/282 |
| 4,194,355 | 3/1980 | Mishida | 368/282 |
| 4,255,801 | 3/1981 | Ode et al. | 368/282 |
| 4,817,065 | 3/1989 | Usui et al. | 368/281 |

FOREIGN PATENT DOCUMENTS

| | | | |
|---|---|---|---|
| 0186804 | 7/1986 | European Pat. Off. | 368/282 |

*Primary Examiner*—Vit W. Miska

*Attorney, Agent, or Firm*—Bruce L. Adams; Van C. Wilks

[57] ABSTRACT

A band base of the wrist band is formed with a cavity for receiving therein a switch member. The band base is formed of elastomer or thermoplastic flexible material and is formed or molded integrally with an internal frame of the watch casing. A band cover is disposed on the band base to cover the cavity thereof. The band cover is molded around its periphery with material comparable to that of the band base by means of a metal mold which has a flow pass covering borders between the band cover and the band base. Further, the internal frame connected to the band base is provided with a holding member for holding and fixing the switch member without engagement to the band base itself such that the switch member can be inserted into the cavity of the band base. Moreover, in order to avoid inadvertent operation of the switch member due to bending of the wrist band, a spacer is disposed around switch contacts of the switch member between the band cover and the switch member so as to maintain a constant spacing therebetween.

18 Claims, 1 Drawing Sheet

FIG. 1
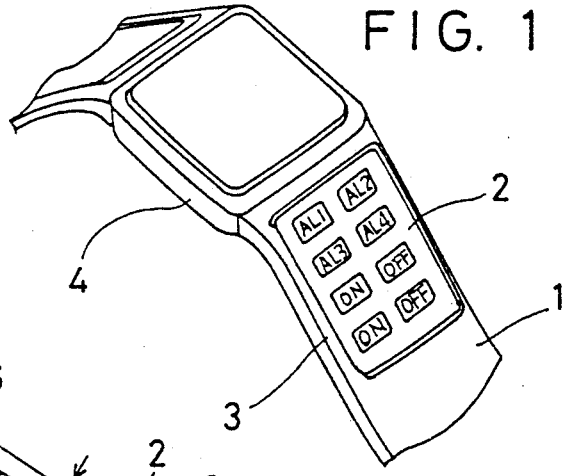
FIG. 2
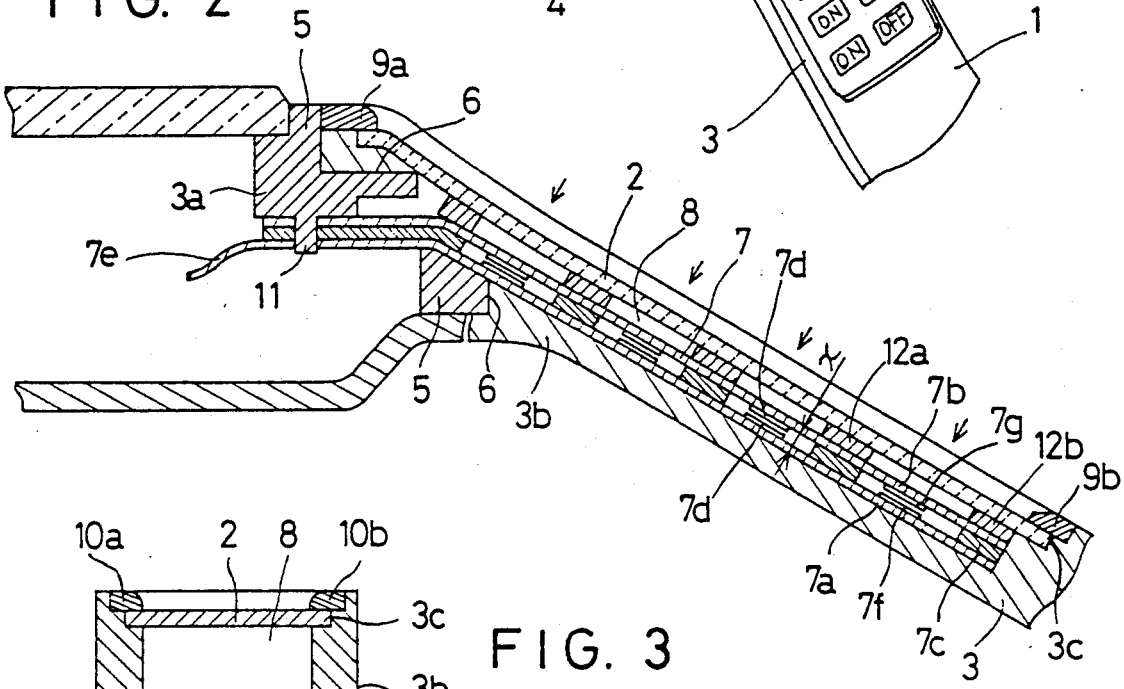
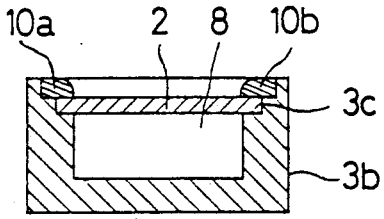
FIG. 3
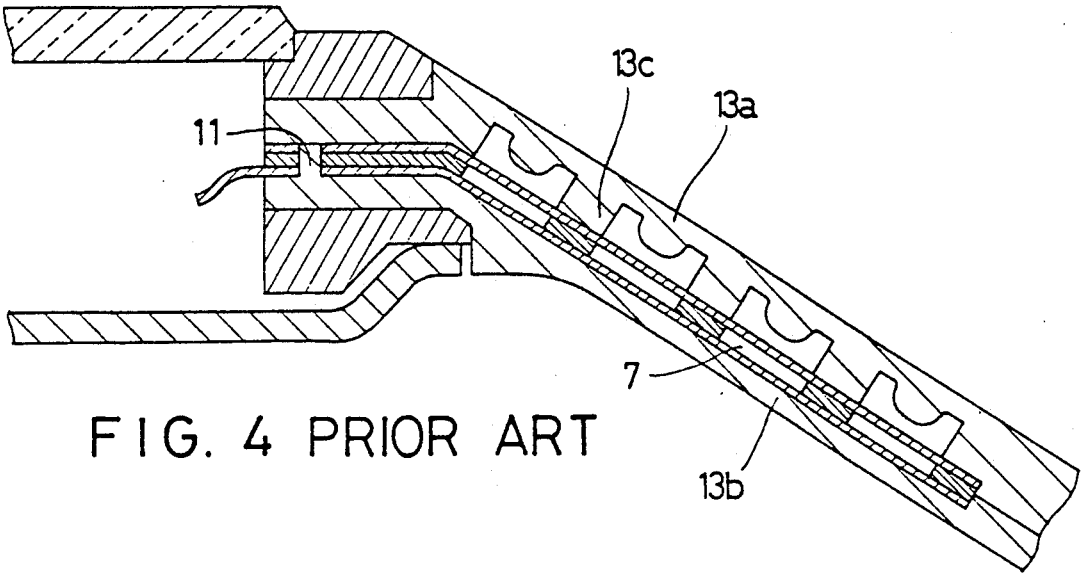
FIG. 4 PRIOR ART

WATCH CASING WITH WRIST BAND SWITCH

BACKGROUND OF THE INVENTION

The present invention relates to structure of a watch casing provided with a wrist band switch.

Japanese Utility Model Registration Application laid-open publication no. 156625/1985 discloses the conventional casing structure in which a flexible substrate of a switch is incorporated into a wrist band of the watch. FIG. 4 shows this conventional structure. In forming the wrist band, first a primary piece 13*a* is molded and a switch member 7 is disposed under the primary piece 13*a*. Thereafter, a lower secondary piece 13*b* is molded integrally with the primary piece 13*a*.

The switch member 7 is held at its one end portion by a holding member 11 which is formed inside the wrist band. Further, the primary piece 13*a* on the switch member is formed with protrusions 13*c* effective to maintain a spacing relative to the switch member.

However, the FIG. 4 structure has three drawbacks. The first drawback relates to forming of the wrist band. Since the molding of the secondary piece 13*b* is effected under the state where the switch member is attached to the primary piece 13*a*, the switch member is exposed directly to heated and melted resin during a secondary molding operation. Further, since the melted resin is flown closely around the switch member, and is cured and shrinked, considerable friction may be caused between the band pieces and the switch member when bending the finished wrist band, thereby hindering flexibility of the wrist band. After repeating the bending of the wrist band during the course of use, the switch member may be broken.

The second drawback is caused by the fact that the holding member of the switch member is formed within the wrist band. In such structure, the switch member could not be incorporated into a cavity of the wrist band after molding. Thus, in the conventional structure, the secondary molding operation must be carried out while super posing the primary band piece and the switch member with each other. Therefore, replacement of the switch member cannot be effected other than cutting the wrist band.

The third drawback is such that the protrusions are integrally formed with the upper band piece in order to maintain a spacing between the upper band piece and the switch member. These protrusions are provided as a spacer, because the upper band piece is stretched to apply pressure toward the lower band piece when the wrist band is bent due to deformation rate difference between the upper and lower band pieces. However, these protrusions are easily dislocated relative to the switch member while bending of the wrist band to thereby impair its spacing function. Therefore, the switch member may be inadvertently operated to cause erroneous input operation of the switch member.

SUMMARY OF THE INVENTION

In order to eliminate the above noted drawbacks, the invention provides the following means. With regard to the forming of the wrist band, neither upper nor lower band pieces are formed in a secondary molding operation. But, a lower band piece or band base is formed with an elongated cavity in a primary molding operation. A separate band cover is disposed on the cavity of the band base. Then, the band cover and the band base are fixed to each other in secondary molding operation by flowing resin around the junction border therebetween.

A holding member is provided within a casing of a watch to hold a flat switch member rather than within the wrist band in order to eliminate the drawback of the prior art that the switch member is not replaced after the forming of the wrist band.

Lastly, a spacer is attached on the flat switch member in order to eliminate the drawback of the prior art that the protrusions of the upper band piece are displaced relative to the switch member due to bending of the wrist band.

During assembly, the band cover is disposed on the band base to cover the cavity thereof, and the periphery of the band cover is sealed by flowing resin in the secondary molding operation. The flat switch member is then removably inserted into the elongated cavity. Therefore, the switch member is not made close or frictional contact with the band body, nor is the switch member subject to high temperature. Therefore, the flexibility of wrist band can be improved, and the switch member may not be easily broken.

Further, since the holding member is disposed outside the band body to fix the switch member, the flat switch member can be inserted into the cavity from an opening of the casing after the forming of the wrist band. Then, the switch member is engaged with the holding member within the casing, thereby enabling replacement of the switch member.

Moreover, the spacer is integrated to the switch member, hence the spacing is maintained between the band cover and the switch member even in the bent state of the wrist band, thereby eliminating inadvertent actuation of the switch member by the bending of the wrist band.

BRIEF DESCRIPTION OF THE DRAWINGS

FIG. 1 is a perspective view of the inventive watch casing with wrist band;

FIG. 2 is a lengthwise sectional view of the inventive watch casing along the wrist band;

FIG. 3 is a widthwise sectional view of the wrist band; and

FIG. 4 is a sectional view of the conventional watch casing.

DETAILED DESCRIPTION OF EMBODIMENT

Hereinafter, an embodiment of the present invention is described in conjunction with the drawings in which FIG. 1 is a perspective view showing the inventive watch casing with wrist band, FIG. 2 is a lengthwise sectional view thereof and FIG. 3 is a widthwise sectional view of the wrist band (switch member is omitted). Referring to FIG. 1, a wrist band 1 is provided thereon with a band cover 2 which includes indicia thereon to indicate the various switch functions. This band cover 2 is fixed at its periphery to a band base 3. A watch casing 4 is formed integrally with and connected to the band base 3.

FIG. 2 is the sectional view taken along the 6–12 o'clock line. In this figure, the band base 3 is connected to an internal frame 5 within the casing through an elastic band portion 3*a* of elastomer formed integrally between the internal frame 5 and the band base 3. The elastic band portion 3*a* constitutes a junction portion 6. A lower lengthwise portion 3*b* of the band base 3 supports thereon switching means in the form of a flat switch member 7 which is comprised of a lower member piece *7a*, an upper piece *7b* and an inner spacer *7c* disposed therebetween. The upper and lower member or pieces are spaced from each other a distance x as indicated in the figure. A pair of switch contacts *7d* are formed on inner faces of the upper and lower pieces in opposed relation to each other. Therefore, the switch member 7 is operated when the upper piece is pressed to the lower piece to couple the pair of contacts *7d* with each other. The flat switch member 7 is received in an elongated and enclosed cavity 8 which is defined by the lower portion *3b* of the band base 3 and the band cover 2.

As shown in FIG. 3, the lower portion *3b* is formed with the cavity 8 for receiving the switch member (not shown) A recess portion *3c* is formed along an upper periphery of the cavity 8 such as to engage with an rectangular periphery of the band cover 2. The band cover 2 is coupled to the band base 3 to cover the cavity 8 by means of a sealer as indicated by reference numerals *9a* and *9b* of FIG. 2 and *10a* and *10b* of FIG. 3.

Namely, the sealer *9a, 9b, 10a* and *10b* is formed along the periphery of the band cover by injection molding to fix and seal the band cover to the band base. As shown in FIG. 2, an end portion *7e* of the switch member is disposed within the internal frame 5 and is attached to a holding member 11 of the internal frame 5. Further, an outer spacer *12a* and *12b* is attached on an upper face of the switch member 7 so as to maintain a spacing between the flat switch member and the band cover. In operation of the switch member, the band cover 2 is manually pressed, for example, as indicated by the arrow mark. Consequently, the band cover is resiliently deformed, for example, between the spacer segments *12a* and *12b* which surrounds a pair of contacts *7f* and *7g* so that the upper piece of the switch member is pressed down to couple the pair of contacts *7f* and *7g* to thereby turn on the switch member.

The invention achieves various effects, which are explained with reference to the embodiment. First, the cavity can be formed easily to contain the switch member of the wrist band 1. Namely, the band cover and the band base are coupled to each other by injection molding to avoid thermal influence to the cavity during the forming of the wrist band. In addition, according to the invention, the switch member is not incorporated during the forming of the wrist band, but is incorporated from the internal frame after the forming of the wrist band. Thus, the switch member is not only affected by the molding operation, but also is easily replaced.

Further, according to the invention, the spacer is attached to the flat switch member so that the spacer is not displaced from the switch member when bending the wrist band to avoid misoperation of the band switch due to bending of the band.

What is claimed is:

1. In a watch casing having an internal frame and a wrist band which is provided with a band switch comprised of a switch member composed of a flexible substrate, the wrist band comprising:

a band base composed of a flexible elastomer and formed integrally with the internal frame and having an elongated cavity adjacent to the internal frame and extending lengthwise of the band base;

a flat switch member disposed in the elongated cavity of the band base, the switch member comprising a pair of films spaced from each other and switch contacts disposed on opposed inner faces of the films and operable to couple with one another to effect a switch function;

a band cover disposed on the band base to cover the elongated cavity to define adjacent to the internal frame an opening through which the flat switch member is inserted into the elongated cavity, the band cover being composed of an elastic sheet printed with switch marks;

a band sealer composed of an elastomer and molded along a periphery of the band cover integrally with the band base; and means disposed in the internal frame for holding an end portion of the flat switch member which extends through the opening into the inside of the internal frame.

2. A watch casing according to claim 1; wherein the flat switch member includes spacers surrounding the switch contacts and being interposed between the flat switch member and the band cover so as to maintain a constant spacing therebetween.

3. A flexible wrist band for a wrist-word device comprising: a flexible band having opposite ends and having an exposed recess which opens at one end of the band; a flexible cover connected to the band and covering the recess to define therewith an enclosed cavity having an opening at the band one end; and switching means removably and replaceably inserted through the opening into the cavity, the switching means comprising a plurality of movable first switch contacts, a plurality of second switch contacts disposed in spaced relation opposite respective ones of the first switch contacts, and means normally maintaining the first and second switch contacts in spaced relation from one another for permitting depression of the flexible cover at preselected locations thereof to move the first switch contacts into contact with the respective second switch contacts.

4. A flexible wrist band according to claim 3; wherein the switching means includes a flexible first member having the first switch contacts mounted thereon in spaced relation from one another, a flexible second member opposed to the first member and having the second switch contacts mounted thereon in spaced relation from one another, and means connecting the first and second members together for removal as a unit from the cavity.

5. A flexible wrist band according to claim 4; wherein the means normally maintaining the first and second switch contacts in spaced relation from one another includes a set of spacers interposed between the first and second members.

6. A flexible wrist band according to claim 5; wherein some of the spacers are disposed in between pairs of opposed first and second switch contacts.

7. A flexible wrist band according to claim 4; including sealing means for sealing the periphery of the cover to the band.

8. A flexible wrist band according to claim 7; wherein the sealing means comprises an elastomer molded around the periphery of the cover.

9. A flexible wrist band according to claim 4; wherein the cover has indicia thereon overlying the respective pairs of opposed first and second switch contacts.

10. A flexible wrist band according to claim 9; wherein the indicia comprise pre-printed indicia printed on the cover before connection of the cover to the band.

11. A flexible wrist band according to claim 3; wherein the cover has indicia thereon overlying the respective pairs of opposed first and second switch contacts.

12. A flexible wrist band according to claim 11; wherein the indicia comprise pre-printed indicia printed on the cover before connection of the cover to the band.

13. A flexible wrist band according to claim 3; including in combination therewith a casing having an opening therethrough aligned with the cavity opening; and means detachably connecting the one end of the band to the casing such that one end of the switching means extends through the aligned cavity and casing openings into the interior of the casing.

14. The combination according to claim 13; wherein the means detachably connecting comprises an annular elastic member detachably connected to the casing and having the one end of the switching means detachably connected thereto within the interior of the casing, whereby detachment and removal of the elastic member from the casing effects withdrawal of the switching means from the cavity.

15. The combination according to claim 14; wherein the casing contains therein a timepiece movement electrically connected to the one end of the switching means.

16. The combination according to claim 14; wherein the switching means includes a flexible first member having the first switch contacts mounted thereon in spaced relation from one another, a flexible second member opposed to the first member and having the second switch contacts mounted thereon in spaced relation from one another, means connecting the first and second member together for removal as a unit from the cavity, and means detachably connecting one of the ends of the first and second members to the elastic member, whereby detachment and removal of the elastic member from the casing effects withdrawal of the first and second members as a unit form the cavity.

17. The combination according to claim 16; wherein the cover has indicia thereon overlying the respective pairs of opposed first and second switch contacts.

18. The combination according to claim 17; wherein the indicia comprise pre-printed indicia printed on the cover before connection of the cover to the band.

* * * * *